US011564463B2

(12) United States Patent
Baumgartner et al.

(10) Patent No.: US 11,564,463 B2
(45) Date of Patent: Jan. 31, 2023

(54) CLASP FOR WRISTLET OR BELT

(71) Applicant: Dress Your Body AG, Cormondrèche (CH)

(72) Inventors: Daniel Baumgartner, Oberwangen b. Bern (CH); Kamel Telidjane, Veysonnaz (CH); Tamás Szöke, Neuchâtel (CH); Stéphane Lauper, Cortaillod (CH)

(73) Assignee: Dress Your Body AG, Cormondrèche (CH)

( * ) Notice: Subject to any disclaimer, the term of this patent is extended or adjusted under 35 U.S.C. 154(b) by 0 days.

(21) Appl. No.: 17/481,896

(22) Filed: Sep. 22, 2021

(65) Prior Publication Data

US 2022/0167715 A1 Jun. 2, 2022

(30) Foreign Application Priority Data

Nov. 27, 2020 (EP) ..... 20210346

(51) Int. Cl.
*A44C 5/24* (2006.01)

(52) U.S. Cl.
CPC ..... *A44C 5/246* (2013.01)

(58) Field of Classification Search
CPC ..... A44C 5/246; A44C 5/24; Y10T 24/2155; Y10T 24/4782
See application file for complete search history.

(56) References Cited

U.S. PATENT DOCUMENTS

| | | | | |
|---|---|---|---|---|
| 1,846,688 | A * | 2/1932 | Meyer | A44C 5/24 24/71 J |
| 2008/0159084 | A1* | 7/2008 | Iten | G04B 37/1486 368/282 |
| 2013/0145586 | A1 | 6/2013 | Kaltenrieder et al. | |
| 2018/0343987 | A1* | 12/2018 | Queloz | A44C 5/147 |
| 2022/0022611 | A1* | 1/2022 | Le Gall | A44C 5/246 |

FOREIGN PATENT DOCUMENTS

| | | | |
|---|---|---|---|
| EP | 2 601 857 | A1 | 6/2013 |
| FR | 3 094 873 | A1 | 10/2020 |
| GB | 123 532 | A | 5/1919 |

(Continued)

OTHER PUBLICATIONS

Machine English translation of FR 3094873 A1 retreived from Espacenet on Jun. 17, 2022.*

(Continued)

*Primary Examiner* — Robert Sandy
*Assistant Examiner* — Rowland Do
(74) *Attorney, Agent, or Firm* — Oblon, McClelland, Maier & Neustadt, L.L.P.

(57) ABSTRACT

A clasp for a wristlet, the clasp including at least one set of four arms hinged with respect to each other so that the clasp can pass from a first position, referred to as the deployed position, wherein the arms are oriented radially towards the outside of the wristlet, to a second position, referred to as the closed position, wherein the arms are folded against each other so as to be placed under the wristlet, this set of four hinged arms including two sets of compasses formed by two arms joined by a hinge, the free end of the arms being mounted pivotally, on a first and on a second part of the wristlet.

10 Claims, 2 Drawing Sheets

(56) References Cited

FOREIGN PATENT DOCUMENTS

| | | | |
|---|---|---|---|
| JP | 1938-007367 | | 8/1938 |
| JP | 57-207231 | A | 12/1982 |
| JP | 10-247674 | A | 9/1998 |
| JP | 2018-536523 | A | 12/2018 |

OTHER PUBLICATIONS

European Search Report dated May 19, 2021 in European Application 20210346.1, filed on Nov. 27, 2020, 3 pages.
Japanese Notice of the Reason for Refusal dated Nov. 8, 2022, in Japanese Patent Application No. 2021-164483 filed Oct. 6, 2021, 7 pages (with English Translation).

* cited by examiner

CLASP FOR WRISTLET OR BELT

CROSS-REFERENCE TO RELATED APPLICATION

This application claims priority to European Patent Application No. 20210346.1 filed on Nov. 27, 2020, the entire disclosure of which is hereby incorporated herein by reference.

FIELD OF THE INVENTION

The invention relates to a clasp for a wristlet with an adjustable part, and in particular for watch wristlets.

BACKGROUND OF THE INVENTION

A clasp for a wristlet having a mechanism comprising a base plate hinged at the end of a plate, and a cap in the form of an inverted U bordering the base plate and the two free edges of which are respectively extended on the same side by a lateral arm, the end of which is mounted for rotation on the corresponding lateral face of the base plate, is known from the document EP 0 607 726. The free edges of the cap can be locked by means of lateral locking means, the adjustable part passing between the base plate and the cap, and being held by a stud protruding from the inner face of the base plate or of the cap.

Manipulating such a mechanism is not easy for a user since it is necessary to release the mechanism by means of a nail in order to be able to adjust the length of the part, and to hold the base plate when it is wished to change the length of the part of the wristlet. In addition, the locking of the mechanism is not completely secure since the cap can release in the case of attaching to something or an impact when the wristlet is being worn.

SUMMARY OF THE INVENTION

The objective of the invention is in particular to overcome the various drawbacks of these known techniques.

More precisely, one objective of the invention is to provide a clasp allowing simple and rapid adjustment of the length of a part of the wristlet.

Another objective of the invention, at least in one particular embodiment, is providing a clasp that is simple to implement and inexpensive.

These objectives, as well as others that will become more apparent hereinafter, are achieved according to the invention by means of a clasp for a wristlet, the clasp comprising at least one set of four arms hinged with respect to each other so that the clasp can pass from a first position, referred to as the deployed position, wherein the arms are oriented radially towards the outside of the wristlet, to a second position, referred to as the closed position, wherein the arms are folded against each other so as to be placed under the wristlet, said set of four hinged arms comprising two compasses formed by two arms joined by a hinge, the free end of the arms being mounted pivotally, on a first and on a second part of the wristlet.

In accordance with other advantageous variants of the invention:

the hinge of the compasses has a pivot axis perpendicular to the plane formed by the wristlet;

at least two free ends of the arms, mounted facing each other on one of the parts of the wristlet, each comprise meshing means so that the pairs of arms pass from the first to the second position simultaneously;

the free ends of the arms are mounted so as to pivot on a loop, said meshing means being mounted between said loop and the free ends of the arms;

the meshing means are in the form of a toothed wheel;

the compasses are disposed symmetrically in accordance with an axial symmetry of axis d, the axis d passing through the free ends of said arms;

the clasp comprises means for holding said free ends of the arms, said holding means being mounted removably on said first part and said second part;

the clasp comprises means for locking in the closed position;

the clasp comprises two sets of four arms hinged with respect to each other, said two sets being connected and hinged together via an intermediate element.

The invention also relates to a watch wristlet including a wristlet provided with a clasp according to the invention.

The invention also relates to a belt loop comprising such a clasp.

Thus the object of the present invention, through the various functional and structural aspects thereof described above, makes it possible to obtain a clasp the manipulation of which is simplified.

SUMMARY DESCRIPTION OF THE DRAWINGS

Other features and advantages of the invention will emerge more clearly upon reading the following description of a particular embodiment of the invention, given by way of simple illustrative and non-limitative example, and from the accompanying figures, among which:

Figure 4A:
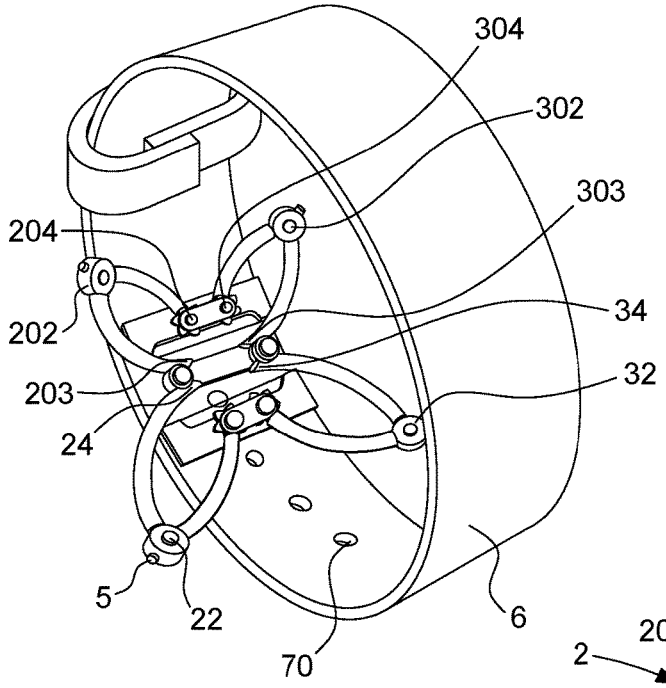
Figure 4B:
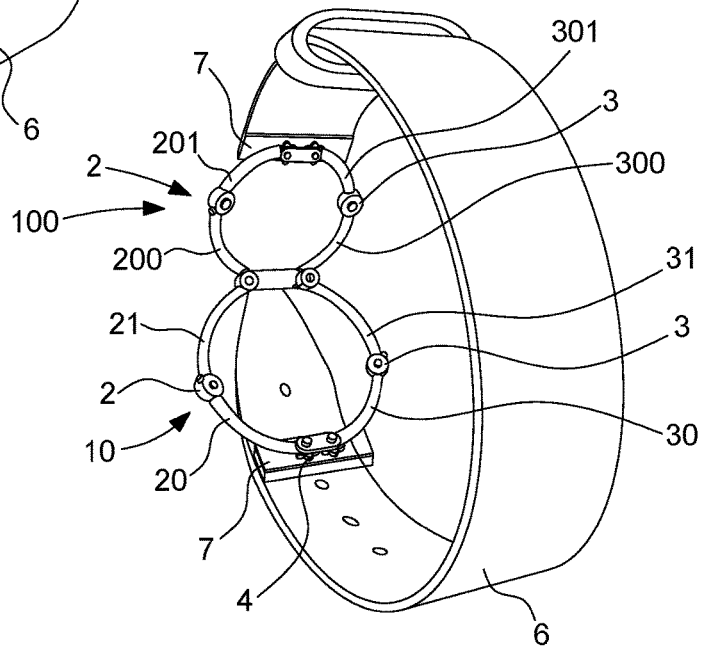

FIGS. 4*a* and 4*b* are perspective views of a clasp in the partially deployed position and deployed according to a second embodiment according to the invention.

DETAILED DESCRIPTION OF THE PREFERRED EMBODIMENTS

A clasp for a wristlet according to a first embodiment will now be described hereinafter with reference conjointly to FIGS. 1 and 2.

According to a first embodiment of the invention, the clasp 1 for a wristlet, the clasp 1 comprising a first set 10 of four arms 20, 21, 30, 31 hinged with respect to each other so that the clasp 1 can pass from a first position, referred to as the deployed position, wherein the arms are oriented radially towards the outside of the wristlet, to a second position, referred to as the closed position, wherein the arms are folded against each other so as to be placed under the wristlet, said set of four hinged arms comprising two compasses 2, 3 formed by two arms 20, 21 and 30, 31 joined by a hinge 22, 32, the free end 23, 24 and 33, 34 of the arms being mounted pivotally, on a first 6 and on a second part 7.

According to the invention, the hinge 22, 32 of the compasses 2, 3 has a pivot axis A perpendicular to the plane formed by the wristlet.

Figure 1:
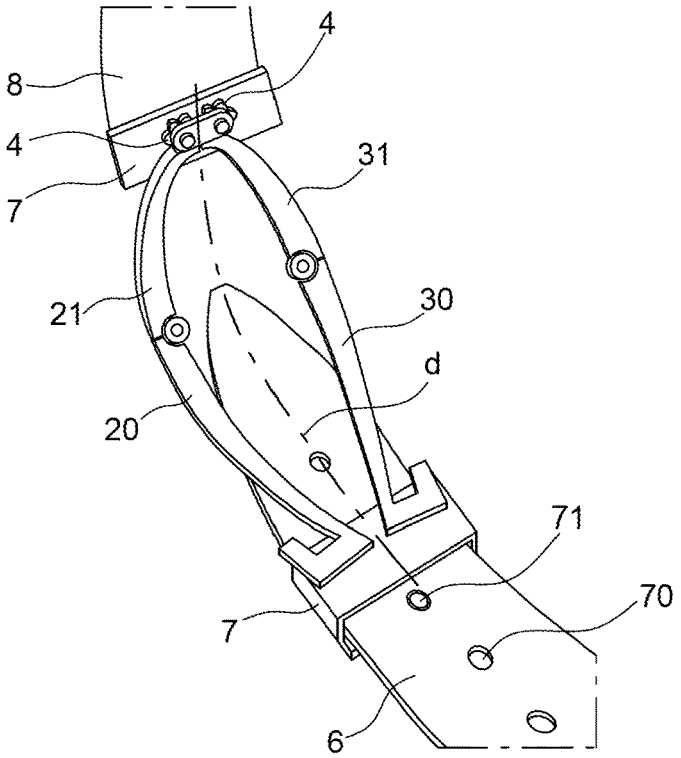
FIG. 1 is a perspective view of a clasp in the deployed position according to the invention.
Figure 2:
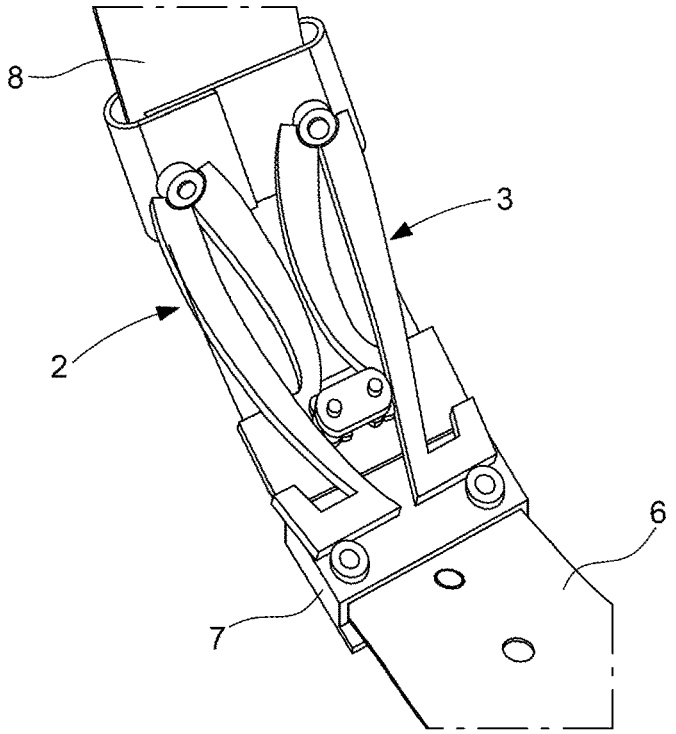
FIG. 2 is a perspective view of a clasp in the closed position according to the invention.

As can be observed in FIGS. 1 and 2, at least two free ends of the arms 23, 33 and 24, 34 are mounted facing each other on one of the parts of the wristlet, in the immediate vicinity of each other, and each comprise meshing means 4 so that the pairs of arms pass from the first to the second position simultaneously. The meshing means are in the form of a toothed wheel or of a pinion, and one arm is secured to a tooth of the wheel or of the pinion. Such an arrangement allows a simultaneous deployment or folding of the compasses 2, 3 when the clasp 1 is manipulated by the wearer.

According to another embodiment, the free ends 24, 34 facing each other comprise a pivot to allow the deployment or folding of the compasses 2, 3 when the clasp 1 is manipulated by the wearer.

The compasses 2, 3 are disposed symmetrically according to an axial symmetry of axis d, the axis d passing through the free ends of the arms.

Figure 3:
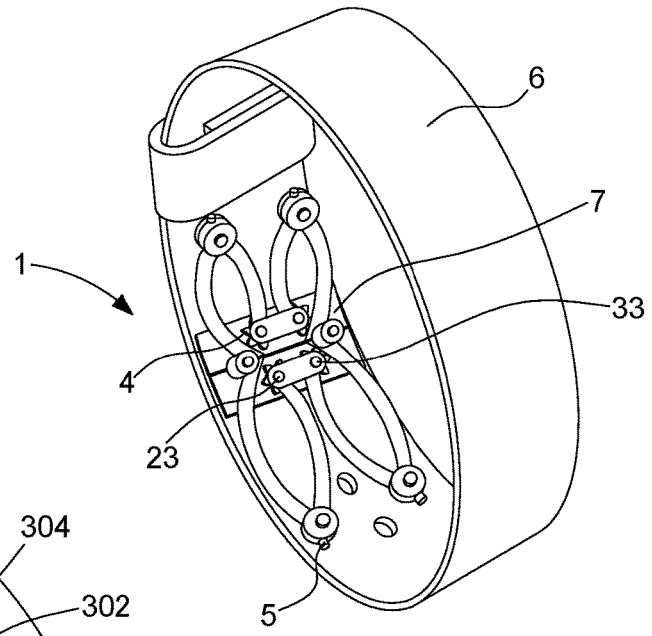
FIG. 3 is a perspective view of a clasp in the closed position according to a second embodiment according to the invention.

As can be observed in FIG. 3, some arms of the compasses may comprise stop means 5 for limiting the travel of the compasses and to cause the compasses to adopt a predetermined shape.

The clasp 1 comprises means for holding the free ends of the arms, said holding means being mounted removably on said first part and said second part. These holding means are in the form of a loop 7 with the width of the part provided with a pin 71 cooperating with an orifice 70 in the wristlet part on which it is mounted, the loop 7 thus being able to be disconnected from the wristlet part as required by the wearer. As can be observed in the figures, the toothed wheels 4 are mounted so as to rotate on each loop on the side in contact with the skin of the wearer so as to conceal the system for closing and/or opening the clasp when the watch is being worn.

The clasp according to the invention also comprises means for locking in the closed position, the loop 7 comprising for this purpose snapping-on means or complementary hooks cooperating with each other when the two loops 7 are against each other in the closed position.

According to a particularly advantageous aspect of the invention, the clasp makes it possible to depict the logo of a brand when it is in the open position.

According to a second embodiment of the invention illustrated in FIGS. 3, 4*a*, and 4*b*, the clasp 1 comprises a first set 10 of four arms 20, 21, 30, 31 hinged with respect to each other and a second set 100 of four arms 200, 201, 300, 301 so that the clasp 1 can pass from a first position, referred to as the deployed position, wherein the arms are oriented radially towards the outside of the wristlet, to a second position, referred to as the closed position, wherein the arms are folded against each other so as to be placed under the wristlet. The first and second set of four hinged arms each comprise two compasses 2, 3 formed by two arms 20, 21, 200, 201 and 30, 31, 300, 301 joined by a hinge 22, 32 and 202, 302. The free ends 23, 33 and 204, 304 of the arms are mounted pivotally, on a first 6 and on a second part 8, and the free ends 24, 34 and 203, 303 of the arms are mounted on an intermediate element 4, such as a plate for example.

Just like the first embodiment, at least two free ends of the arms 23, 33 and 204, 304 are mounted facing each other on one of the parts of the wristlet, each comprising meshing means so that the pairs of arms pass from the first to the second position simultaneously during deployment or folding by the wearer.

In this second embodiment, the means for locking in the closed position are located on the intermediate element and the two loops, the two loops coming to snap or attach onto the intermediate element when the clasp 1 is in the closed position.

To open or close the clasp, the user pulls or pushes on the parts 6 and 8, so that the compasses 2, 3 are deployed or close. Finally, the clasp is locked once the user positions the loops 7 against each other in order to snap them on or attach them.

The invention also relates to a watch wristlet including a wristlet provided with a clasp as described above.

By virtue of these various aspects of the invention, a clasp is available of simple design, and easy to close or deploy, while procuring a particular aesthetic aspect.

The invention claimed is:

1. A clasp for a wristlet, comprising:

at least one set of four arms hinged with respect to each other so that the clasp can pass from a first position, referred to as the deployed position, wherein the arms are oriented radially towards the outside of the wristlet, to a second position, referred to as the closed position, wherein the arms are folded against each other so as to be placed under the wristlet, said set of four hinged arms comprising two compasses formed by two arms joined by a hinge, the free ends of the arms being mounted pivotally, on a first and on a second part of the wristlet, wherein at least two free ends of the arms, mounted facing each other on one of the parts of the wristlet, each comprises meshing means so that the pairs of arms pass from the first to the second position simultaneously, wherein the free ends of the arms are mounted so as to pivot on a loop, said meshing means being mounted between said loop and the free ends of the arms, and wherein the meshing means are in the form of a toothed wheel.

2. The clasp according to claim 1, wherein said hinge of the compasses has a pivot axis perpendicular to the plane formed by the wristlet.

3. The clasp according to claim 1, wherein the compasses are disposed symmetrically in accordance with an axial symmetry of an axis d, the axis d passing between the free ends of said arms.

4. The clasp according to claim 1, further comprising means for holding said free ends of the arms, said holding means being mounted removably on said first part and said second part.

5. The clasp according to claim 4, wherein the means for holding said free ends of the arms are loops mounted removably on said first part and said second part.

6. The clasp according to claim 4, wherein the loops comprise pins configured to cooperate with orifices in the wristlet.

7. The clasp according to claim 1, further comprising means for locking in the closed position.

8. The clasp according to claim 1, further comprising two sets of four arms hinged with respect to each other, said two sets being connected and hinged together via an intermediate element.

9. A watch wristlet comprising a wristlet provided with a clasp according to claim 1.

10. A belt loop comprising a clasp according to claim 1.

* * * * *